United States Patent [19]

Wiget et al.

[11] 4,382,692

[45] May 10, 1983

[54] ANALOG-DISPLAY ELECTRONIC TIMEPIECE COMPRISING A DIVIDER WITH AN ADJUSTABLE DIVISION FACTOR

[75] Inventors: Fridolin Wiget; Rene Besson, both of Neuchatel, Switzerland

[73] Assignee: Ebauches, S.A., Switzerland

[21] Appl. No.: 283,491

[22] Filed: Jul. 15, 1981

Related U.S. Application Data

[63] Continuation of Ser. No. 97,532, Nov. 26, 1979, abandoned.

[51] Int. Cl.³ ..... G04F 5/00; G04B 17/12

[52] U.S. Cl. ..... 368/157; 368/201

[58] Field of Search ..... 368/47, 85, 155–160, 368/184–187, 200–202, 217

[56] References Cited

U.S. PATENT DOCUMENTS 3,998,044 12/1976 Yamauchi et al. ..... 368/187
4,142,360 3/1979 Akahane ..... 368/201
4,154,053 5/1979 Chetelat et al. ..... 368/201
4,282,594 8/1981 Ichikana ..... 368/82

*Primary Examiner*—Vit W. Miska
*Attorney, Agent, or Firm*—Allegretti, Newitt, Witcoff & McAndrews, Ltd.

[57] ABSTRACT

An electronic watch comprising a stepping motor for driving a mechanism for displaying the time information, a quartz oscillator, a frequency divider with an adjustable division factor, a circuit for adjusting the division factor, a memory containing data relating to the magnitude of said adjustment and a logic circuit which, in response to an interrogation signal, produces a measuring signal which is supplied to the coil of the stepping motor and which comprises pulses whose distribution is representative of the division factor and the frequency of the oscillator and whose duration is sufficiently short so as not to cause the motor to turn and sufficiently long to cause a magnetic stray field of the coil of the motor which can be detected by an external apparatus for measuring the rate of the watch.

2 Claims, 3 Drawing Figures

ANALOG-DISPLAY ELECTRONIC TIMEPIECE COMPRISING A DIVIDER WITH AN ADJUSTABLE DIVISION FACTOR

This is a continuation of application Ser. No. 97,532 filed Nov. 26, 1979 now abandoned.

BACKGROUND OF THE INVENTION

The present invention concerns an electronic timepiece concerning an oscillator used as a time base, a frequency divider with an adjustable division factor, which is coupled to the oscillator, a circuit for adjusting the division factor, a memory which is associated with the adjusting circuit and whose state represents the magnitude of said adjustment, and a transducer responsive to a signal generated in the timepiece by the emission of a wave which can be detected by an outside apparatus for measuring the rate of the timepiece.

For the purposes of measuring the rate of watches of this kind, use is made of devices which detect the magnetic stray field of the coil of the stepping motor, and which precisely measure the time which elapses between two drive pulses.

These devices rapidly give the required measured result when the drive pulses are separated by short periods of time, for example a second. On the other hand, in the case of watches which do not have second hands and in which the drive pulses may be spaced at from 10 to 20 seconds or even a minute, the rate measuring time is much longer.

U.S. Pat. No. 3,998,044 discloses apparatus which makes it possible to shorten the time required for measuring the rate of such watches, by supplying their motors with pulses which are produced by an intermediate stage of the frequency divider and which are sufficiently short for them not to cause the motor to react, while being of a sufficiently high frequency for the measuring time to be short. However this apparatus cannot be used for watches in which the frequency divider has an adjustable division factor. In such watches, which are described for example in Swiss Pat. Nos. 534,913 and 558,559, pulses are suppressed or added at certain positions in the division chain in the course of each adjustment cycle, which cycle may last up to 64 seconds. As a result of this, in the course of one of the adjustment cycles, the time between two successive drive pulses is not constant.

In order to be certain of correctly determining the rate of the watch, it is therefore necessary to compute the mean time which elapses between two drive pulses from the measured values of the time which elapses between each pulse appearing for a period of time which is at least equal to an adjustment cycle. The difficulty with such measurement operations is that nothing indicates the commencement or the end of an adjustment cycle.

BRIEF SUMMARY OF THE INVENTION

The aim of the present invention is to remedy these disadvantages by providing the watch with means for delivering to its motor signals that do not cause the motor to react but that make it possible for the rate of the watch to be rapidly and accurately measured, taking account of the real frequency of the oscillator and the division factor of the frequency divider.

BRIEF DESCRIPTION OF THE DRAWING

The drawing shows by way of example an illustrative embodiment of the subject of the invention.

DETAILED DESCRIPTION OF THE PREFERRED EMBODIMENT

For the purposes of simplifying the description, the following abbreviations will be used:

logic state 0 or 1: '0' or '1' respectively flip-flop D: FF Monostable multivibrator: MONO Reset: RAQ Input (or output) Xa of the element X: Input (or output) Xa In addition, the term 'quartz second' will be used to denote a period of time which is equal to a second of real time, multiplied by the quotient of the nominal frequency and the real frequency of oscillation of the quartz of the watch in question.

Figure 1:
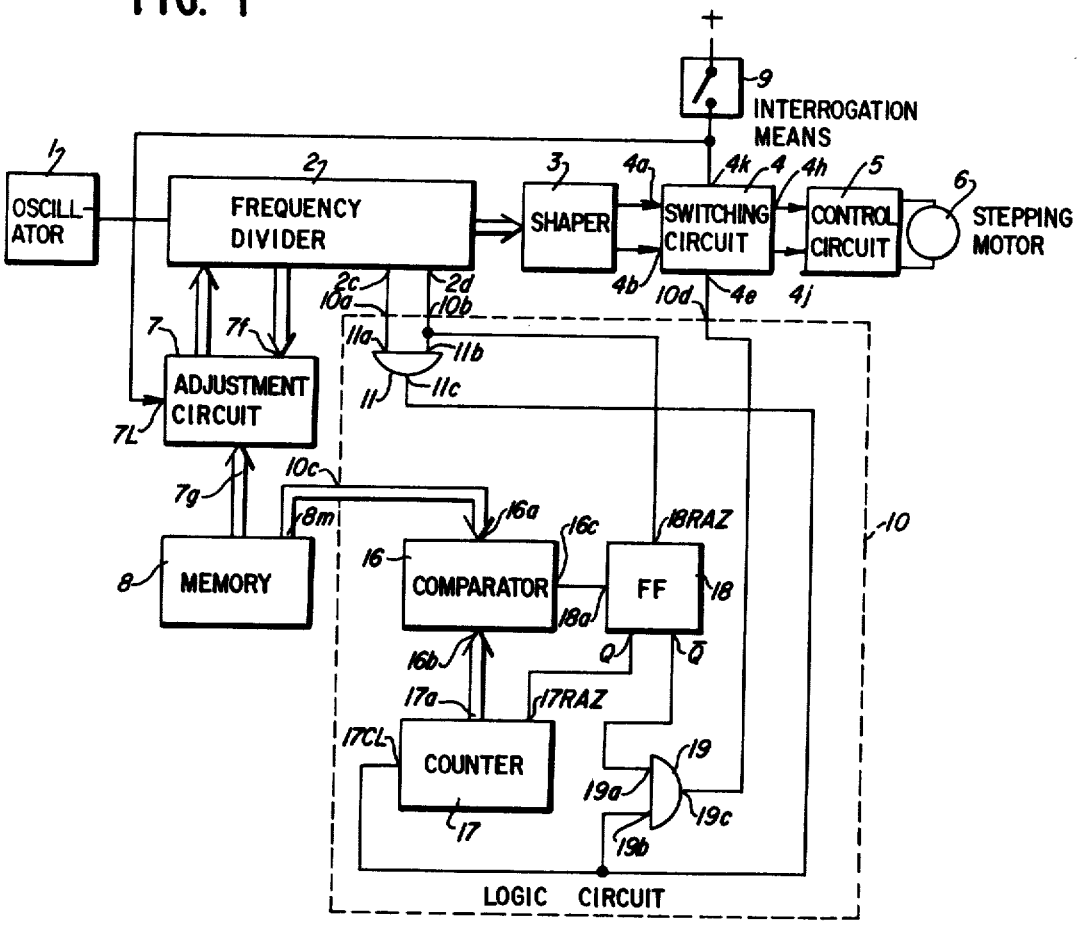
FIG. 1 shows the block circuit diagram of one preferred embodiment of the invention.

An illustrative embodiment of the invention is illustrated by means of the circuit of FIG. 1, which comprises a quartz oscillator 1 supplying pulses at a frequency for example of 32,768 Hz, with a positive or negative tolerance of the order of 1 per 100,000 (this being a value which is generally achieved in manufacture), to a frequency divider 2 which has an adjustable division factor and which is provided for reducing the frequency of the pulses supplied by the oscillator to a precise frequency of, for example, 1 Hz. A circuit 3 for shaping the drive pulses is connected to the output of the divider 2; the two outputs of the shaper circuit 3 are connected to the inputs 4*a* and 4*b* of a change-over switching circuit 4 whose two outputs 4*h* and 4*j* are connected to a control circuit 5 for supplying drive pulses to the coil of a stepping motor 6 which drives a display mechanism (not shown here).

A circuit 7 for adjusting the division factor is connected to the frequency divider 2. Such a circuit 7 is known in particular from above-mentioned Swiss Pat. No. 534,913 which describes an adjustment circuit intended to suppress a certain number of pulses, from the pulses which are supplied by the oscillator, for a given period of time. In this case, the frequency of the oscillator is deliberately selected at an excessively high value.

Swiss Pat. No. 558,559 describes another system in which the adjusting circuit adds pulses to those supplied by the oscillator or, which comes to the same thing, periodically reduces the division factor of the frequency divider for a given period of time. This makes it possible to use a quartz whose frequency is lower than the nominal frequency.

Irrespective of the system in question, the adjusting circuit 7 is connected to a memory 8 which contains data concerning the magnitude of the adjustment to be made. The memory may be in various forms and in particular may comprise electronic components.

The watch is provided with a stem for setting the time (not shown), which may assume three axial positions: in the inwardly displaced position or position 1, the stem is inactive; in the middle position or position 2, it makes it possible to move the hands in order to set the time on the watch; while in the completely pulled position or position 3, the stem acts on an interrogation means 9 which is shown in FIG. 1 by a switch connected between the positive terminal of the battery which supplies the motor and by way of any known type of adaptation or matching circuit (not shown), the inputs 4*k* of the switching means 4 and 7L of the adjusting circuit 7.

A logic circuit 10 is provided with inputs 10*a* and 10*b* which are respectively connected to the outputs 2*c* and 2*d* of the divider 2, a plurality of inputs 10*c* connected to the outputs 8*m* of the memory 8 and an output 10*d* connected to the information output 4*e* of the switching circuit 4.

The logic circuit 10 comprises elements 11 to 19 which will be described hereinafter.

The inputs 10*a* and 10*b* are connected to the inputs 11*a* and 11*b* respectively of an AND-gate 11.

The inputs 10*c* are connected to the inputs 16*a* of a comparator 16 whose inputs 16*b* are connected to the outputs 17*a* of the division stages of a counter 17. The output 16*c* is connected to the clock input 18*a* of a FF18. The non-inverted output Q and the inverted output Q of the FF18 are respectively connected to the resetting input 17RAQ of the counter and to the input 19*a* of an AND-gate 19. The resetting input 18RAZ is connected to the input 11*b* of the gate 11. The output 11*c* of the gate 11 is connected on the one hand to the clock input 17CL of the counter and on the other hand to the input 19*b* of the gate 19. The output 19*c* is connected to the output 10*d* of the logic circuit 10.

The mode of operation of the frequency divider 2 which has an adjustable division factor, the adjustment circuit 7 for adjusting the division factor of the frequency divider and the memory 8 are described in above-mentioned Swiss Pat. Nos. 534,913 and 558,559. It may simply be noted that the adjustment circuit 7 receives at its input 7*f* from the divider 2, data concerning the duration of the adjusting cycle, while at its input 7*g* the adjusting circuit 7 receives data concerning the magnitude of the adjustment in respect of the division factor, which data are contained in the memory 8 in the form of a number whose unit at least approximately corresponds, in the example described, to a correction of one tenth of a second per day in the rate of the watch.

The shaper circuit 3 uses the signals supplied by the divider 2 in order to produce a pulse each second alternately at one and the other of its outputs. Under normal circumstances, the pulses occur at the outputs of the circuit 4 and are used by the control circuit 5 in order to supply the motor 6 with the alternate drive pulses which cause it to move forward by one step per second. The shaper circuit 3 is of any well known type and need not be described in detail herein.

Figure 3:
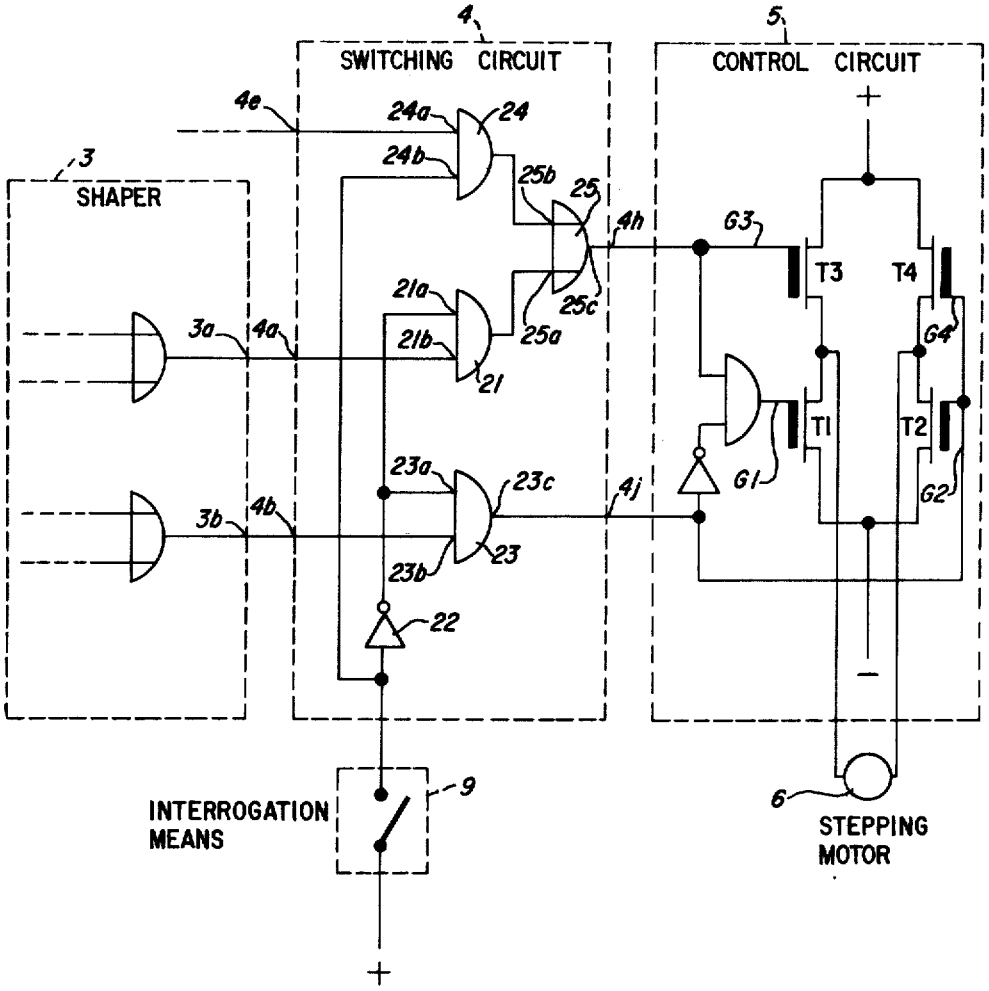
FIG. 3 shows a diagram of a detail of the circuit of FIG. 1.

FIG. 3 shows a circuit diagram of the switching means 4 of FIG. 1, which is disposed between the shaper circuit 3 and the control circuit 4.

The first output 3*a* of the shaper 3 is connected to a first input 4*a* of the switching means 4, which, in turn, is connected to the input 21*b* of an AND-gate 21. The other input 21*a* of AND-gate 21 is connected to the output of an inverter 22. The second output 3*b* of the shaper 3 is connected to a second input 4*b* of the switching means 4. Input 4*b* is connected to the input 23*b* of an AND-gate 23 whose other input 23*a* is also connected to the output of the inverter stage 22. The data input 4*e* is connected to the input 24*a* of an AND-gate 24 whose other input 24*b* is connected to the control input 4*k* of the switching means 4. The input 4*k* is also connected to the input of the inverter 22. The outputs of the gates 21 and 24 are respectively connected to the inputs 25*a* and 25*b* of an OR-gate 25 whose output 25*c* is connected to the output 4*h* and thence to one of the inputs G3 of the control circuit 5. The output 23*c* of the gate 23 is connected to the output 4*j* and to the other input of the circuit 5.

When the stem of the watch is in position 1 or position 2, the switch 9 of the interrogation means is open and the input 4*k* of the switching means 4 is at logic state '0'. Consequently, the same logic state also occurs at the input 24*b* of the gate 24, preventing the signal at the input 4*e* from reaching the input 25*b* of the gate 25. The input of the inverter 22 also being at '0', its input then is at logic state '1' which is transmitted to the inputs 21*a* and 23*a* of the gates 21 and 23, whereby on the one hand the signal at the input 4*a* is permitted to reach the output 4*h* by way of the OR-gate 25 and on the other hand the signal at the input 4*b* is permitted to pass to the output 4*j*.

When the rate of the watch is to be measured, the stem is pulled into position 3 whereby the switch 9 of the interrogation means is closed and a logic state '1' appears at the input 4*k* of the switching means 4, and consequently at the input 24*b* of the gate 24 and at the input of the inverter 22. This logic state permits the signal arriving at the data input 4*e* to reach the output 4*h* by way of the OR-gate 25. With the output of the inverter 22 being in the logic state '0', the gates 21 and 22 are closed, preventing the signals at the inputs 4*a* and 4*b* from reaching the outputs 4*h* and 4*j* of the switching means 4. The output 4*j* is consequently in logic state '0'.

It follows that the control circuit 5, which is connected to the outputs 4*h* and 4*j*, in this case receives only the signal at the input 4*e*, the formation of which signal will be described hereinafter.

When the signal 4*h* is at '0', only the transistor T1 is conducting; therefore, the coil of the motor 6 does not receive any current. At each pulse of the signal 4*h*, to control gates G1 and G3 of the transistors T1 and T3 remain in or switch to the logic state '1', while the gates G2 and G4 of the transistors T2 and T4 remain in the logic state '0'. Consequently, the transistors T1 and T4 conduct and the transistors T2 and T3 are non-conducting, thus giving the coil of the motor 6 a current pulse. In the embodiment described, this pulse lasts for about 2 mS, which is sufficiently long to permit measurement of the pulse by means of a device based on detection of the magnetic stray field of the motor.

Figure 2:
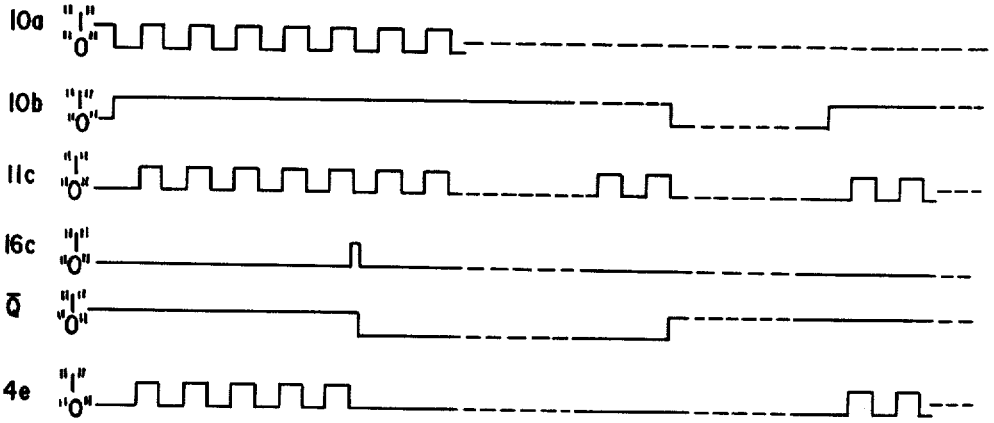
FIG. 2 is a diagram illustrating the mode of operation of the circuit of FIG. 1.

The mode of operation of the logic circuit 10 of FIG. 1, which is intended to supply the signals for permitting rapid measurement of the rate of the watch when the stem of the watch is in position 3, will now be described with reference to the diagram in FIG. 2 showing the shape of the signals present at different points on the circuit.

When this measurement is to be made and the stem of the watch is in position 3, the switch 9 of the switching means is closed and applies an interrogation signal '1' to the input 7L of the adjusting circuit 7. The latter is so arranged to no longer be active when its input 7L is at '1' and the divider 2 then operates without adjustment of its division factor.

From the output of two different stages of the divider 2, the inputs 10*a* and 10*b* receive signals at a frequency, for example, of 1 Hz and 256 Hz respectively.

The output 11*c* of the AND-gate 11 then periodically supplies trains of pulses which are half a quartz second in duration, the width of each pulse being about 2 mS.

The pulses are on the one hand counted by the counter 17 and on the other hand transmitted to the input 19*b* of the gate 19. The output 19*c* of the gate 19 supplies those pulses to the data output 10*d* as long as the output Q of the FF 18 is at '1'.

The state of the outputs 17*a* of the division stages of the counter 17 is compared to the state of the outputs 18*m* of the memory 8 by the comparator 16. When these states coincide, the output 16*c* goes from '0' to '1', which causes a change in the state of the outputs Q and Q of the FF18 which go respectively to '1' and '0'. This change causes the counter 17 to be reset to zero and causes closure of the gate 19 which no longer allows the signal supplied by the output 11*c* to pass to the output 10*d*.

At the end of a fresh half-quartz second, the FF 18 is reset by the signal occurring at the input 10*b*, which causes the signal for resetting the counter 17 to disappear. The counter 17 can therefore count a fresh train of pulses. In addition, at the same moment, the input 10*a* is again at '1', which permits the fresh train of pulses to pass through the gate 19.

It will be seen therefore that, at each quartz second, a train of pulses is supplied by the output 10*d* to the data input 4*e* of the switching means 4. These trains of pulses form the measuring signal which is passed to the coil of the stepping motor, as already described above.

The diagram shown in FIG. 2 illustrates an example in which the memory 8 contains the number 5 and in which the measuring signal (10*d*/4*e*) therefore comprises five pulses in each train of pulses. It will be recalled that, in this embodiment, this number which is contained in the memory 8 represents the number of pulses which are suppressed in each adjusting cycle, from the pulses which are supplied by the oscillator 1 to the divider 2.

The rate of a watch of this kind, of inhibition-type, can be calculated by means of the following formula:

$$m\ (s/d) = 86\,400\left(P - 1 + \frac{N \times 10^{-6}}{4.194304}\right)$$

in which m is the rate of the watch in seconds per day, P is the period of a train of pulses of the measuring signal 4*e*, N is the number of pulses contained in each train of the measuring signal 4*e*, that is to say, the number of pulses suppressed from the pulses supplied by the oscillator in each adjusting cycle, 86,400 is the number of seconds in 24 hours ant $4.194304 \times 10^6$ is the result of the product of 32768 Hz (frequency of the oscillator) and 128 s (period of an adjusting cycle).

For example, if P is measured at 0.9999904 s and N is measured at 50, we have:

$$m = 86400\left(0.9999904 - 1 + \frac{50 \times 10^{-6}}{4.194304}\right) = 0.2\ s/d$$

Such a calculation is tedious and in order to avoid it, apparatus for measuring the rate of a watch provided with an electronic circuit as illustrated in FIG. 1 has been developed. This measuring apparatus is described in Swiss patent application No. 81238 filed on Nov. 24th, 1978.

It will be apparent that the manner of transmitting the measuring signal outside of the watch may be different from that described hereinbefore. For example, the measuring signal could be an electro-acoustic wave produced and transmitted by means of an electro-acoustic type of transducer on the watch. Likewise, it would be possible to provide for a different manner of forming the measuring signal wherein the content of the memory of the adjusting circuit for adjusting the division factor could be for example introduced in coded form.

Various other modifications may be made in the form of the invention without departing from the principles disclosed in the foregoing illustrative embodiments. It is intended therefore that the accompanying claims be construed as broadly as possible consistent with the prior art.

What is claimed is:

1. An electronic timepiece comprising:

an oscillator for delivering a high frequency signal;

a dividing means having a plurality of dividing stages; each state delivering a low frequency signal;

an adjustment memory for storing a division factor;

a time display means;

a motor provided with a coil and a rotor for driving said display means;

means for applying pulses to said coil in response to control pulses;

manually operable means for delivering an interrogation signal when said manually operable means are actuated;

an adjustment circuit responsive to the absence of said interrogation signal for adjusting the division factor of at least one of said dividing stages in accordance with the memory division factor for said dividing means to deliver an adjusted low frequency signal;

means for producing a measuring signal in response to two frequency signals delivered by two different dividing stages representative of said high frequency signal and said memory division factor, said measuring signal consisting of pulses all having the same duration; and switching means controlled by said manually operable means for delivering said control pulses in reply to said adjusted low frequency signal when said interrogation signal is absent and to said measuring signal when said interrogation signal is present, the duration of said measuring pulses being too short for said pulse applying means to apply pulses to said coil capable of rotating said rotor, but long enough for said pulse applying means to apply pulses to said coil to produce a wave which can be detected by apparatus exterior to said timepiece.

2. The electronic watch of claim 1 wherein said measuring signal producing means comprises first means for generating pulses having a duration and a frequency defined by the highest of said two different frequencies, means for selecting a number of said pulses which is equal to said memory division factor, and means for generating trains of said selected pulses, said trains having a frequency defined by the frequency of the lowest of said two different frequency signals, said trains of pulses forming said measuring signal, whereby said control signal has a frequency which is independent of said division factor when said interrogation signal is present and which is representative of the frequency of said high frequency signal.

* * * * *